US009545558B2

(12) United States Patent
Gelin et al.

(10) Patent No.: US 9,545,558 B2
(45) Date of Patent: Jan. 17, 2017

(54) DEVICE FOR RETAINING A SHOE ON A GLIDING BOARD

(71) Applicant: Skis Rossignol, Saint-Jean de Moirans (FR)

(72) Inventors: Vincent Gelin, Grenoble (FR); Adrien Reguis, Grenoble (FR); Arnaud Repa, Le Fontanil-Cornillon (FR)

(73) Assignee: SKIS ROSSIGNOL, Saint-Jean-de-Moirans (FR)

( * ) Notice: Subject to any disclaimer, the term of this patent is extended or adjusted under 35 U.S.C. 154(b) by 0 days.

(21) Appl. No.: 14/971,428

(22) Filed: Dec. 16, 2015

(65) Prior Publication Data

US 2016/0175687 A1 Jun. 23, 2016

(30) Foreign Application Priority Data

Dec. 19, 2014 (FR) ..... 14 62952

(51) Int. Cl.
*A63C 10/00* (2012.01)
*A63C 10/06* (2012.01)

(52) U.S. Cl.
CPC ..... *A63C 10/06* (2013.01)

(58) Field of Classification Search
CPC ..... A63C 10/04–10/06
See application file for complete search history.

(56) References Cited

U.S. PATENT DOCUMENTS 6,116,634 A * 9/2000 Mometti ..... A63C 10/04 280/613
6,926,302 B1 8/2005 Carpenter et al.

FOREIGN PATENT DOCUMENTS

| | | | |
|---|---|---|---|
| DE | 638 520 | | 11/1936 |
| EP | 0 793 983 | A | 9/1997 |
| EP | 1 935 460 | A | 6/2008 |
| EP | 2 620 189 | A | 7/2013 |
| FR | 2774302 | A | 8/1999 |
| FR | 2820049 | A | 8/2002 |
| FR | 2878757 | A | 6/2006 |
| WO | WO 02/051511 | A | 7/2002 |
| WO | WO 2007/009840 | A | 1/2007 |

OTHER PUBLICATIONS

Search Report issued by French Patent Office for priority application FR 1462952 dated Jul. 17, 2015.

* cited by examiner

*Primary Examiner* — Erez Gurari
(74) *Attorney, Agent, or Firm* — Frommer Lawrence & Haug LLP

(57) ABSTRACT

The invention relates to a device for retaining the shoe on a gliding board comprising a lower base (E) designed to be secured to the board and receiving the shoe, and at least one upper fastener (1) ensuring closing of the device while being secured to the base on the one hand, and locked on a central tab (2) bearing on said shoe on the other hand, in the locked position, characterized in that said central tab comprises an inner part (21) and an outer part (22) that are superimposed, said inner part including at least one protruding element (23) becoming engaged through a corresponding orifice (20) arranged in the outer part (22), this protruding element forming a loop (30) for said fastener.

12 Claims, 4 Drawing Sheets

DEVICE FOR RETAINING A SHOE ON A GLIDING BOARD

The invention relates to a device for retaining a shoe on a gliding board.

More specifically, the invention relates to an improvement to the closure system for such a device.

Devices for retaining shoes on gliding boards or surfboards generally comprise a rigid lower base designed to be secured on the board and receiving the shoe, and at least one upper fastener (such as a strap or rack) secured to the base that is locked bearing on the shoe using a tightening member to ensure closing of the device.

A device of this type is in particular described in FR 2,774,302 and EP 1,935,460, where the base is provided with sets of straps whereof the length-adjustable segments are blocked on a central connecting tab bearing a tightening member and also forming a cushion bearing on the upper part of the shoe.

In these embodiments, after adjustment, blocking and tightening of the straps, their end segments have an excess length that protrudes on top of the shoe and may cause bother to the user.

In FR 2,820,049 and U.S. Pat. No. 6,926,302, this excess length of strap or rack is housed in a sheath or duct arranged in the thickness of the central connecting tab, while in EP 793,983, the excess length is immobilized in a loop like a belt.

However, these prior solutions are not satisfactory, since the structure of the central tab is too thin to make it possible to arrange a sheath in its thickness.

Even when it is possible to produce a sheath, the manual engagement of the strap in the sheath is delicate, particularly when gloves are worn.

In the particular case of document EP 793,983, this tab is formed by several parts assembled to one another. The rigidity of the central tab is excessive and detrimental to the user comfort and firm maintenance of the shoe.

Furthermore, the method for fastening the different parts to one another is complex.

According to the alternative embodiments of the known devices, the fasteners can also be made from different materials with greater or lesser rigidity (for example, a rack made from a more or less hard thermoplastic material or a strap made from a flexible textile), which conditions the shape and structure of means able to immobilize its excess length.

BRIEF DESCRIPTION OF THE INVENTION

The invention aims to resolve the technical problems posed by the prior art, and more specifically, to propose a solution making it possible to minimize the number of component parts of the central tab as well as its bulk heightwise and to facilitate the assembly of these different parts and the taking up of the excess length of the fastener after adjustment thereof.

According to the invention, this aim is achieved using a device for retaining the shoe on a gliding board comprising a lower base designed to be secured to the board and receiving the shoe, and at least one upper fastener ensuring closing of the device while being secured to the base on the one hand, and locked on a central tab bearing on said shoe on the other hand, in the locked position, characterized in that the central tab comprises an inner part and an outer part that are superimposed, said inner part including at least one protruding element becoming engaged through a corresponding orifice arranged in the outer part, this protruding element forming a loop for said fastener.

Preferably, the protruding element is elastically deformable.

According to a first advantageous alternative, the protruding element is a lug comprising two substantially perpendicular branches, the end branch extending remotely and substantially parallel to said outer part to delimit said loop designed for the housing of the fastener.

According to one advantageous feature, the end branch connects to the inner part via an intermediate branch crossing through the facing orifice arranged on the outer part.

According to one specific alternative, the inner part bears at least one series of protruding elements grouped together in pairs and the free ends of which are across from one another two by two.

Preferably, the inner part bears two series of protruding elements, each cooperating with a lateral fastener locked on either side of said central tab.

According to one advantageous feature, the opposite free ends of these protruding elements delimit a slot whose width is smaller than the width of the fastener.

According to another alternative, the protruding element is in the form of a bridge whereof the end branch is connected by its ends, respectively, to two intermediate branches.

According to another feature, the outer part forms a reinforcement and has a rigidity greater than the inner comfort part.

According to still another alternative, the inner part further bears bosses designed to clip under stresses in complimentary cavities arranged opposite on each outer part to reinforce the mutual wedging of the two parts after assembly.

According to other features, the protruding element borne by the inner part is forcibly engaged in the matching orifice situated on the outer part to ensure the assembly of said inner and outer parts.

Preferably, the inner part has the same profile and the same dimensions as the outer part.

The invention makes it possible to improve the method for manufacturing the device by ensuring, simply and reliably, a connection between the two component parts of the connecting tab offering ergonomic retaining and immobilizing means for the excess length of the fasteners on this tab.

The device according to the invention is further suitable for all types of fasteners (textile strap, notched straps of the rack type, for example, etc.) while having a light and compact structure.

Owing to the invention, the structure of the central tab becomes very strong while remaining flexible enough to closely hug the shape of the shoe.

The invention can also apply to the central connecting tab, which provides support under the instep in the top part of the upper as well as that covering the metatarsal-phalangeal part situated on the front of the shoe.

BRIEF DESCRIPTION OF THE FIGURES

Other features and advantages of the invention will emerge from reading the following description, in reference to the appended figures outlined below.

For greater clarity, identical or similar elements are identified using identical reference signs in all of the figures.

Naturally, the embodiments illustrated by the figures described above are provided only as non-limiting examples. It is explicitly provided that these various embodiments may be combined with one another.

DETAILED DESCRIPTION OF THE INVENTION

Figure 1:
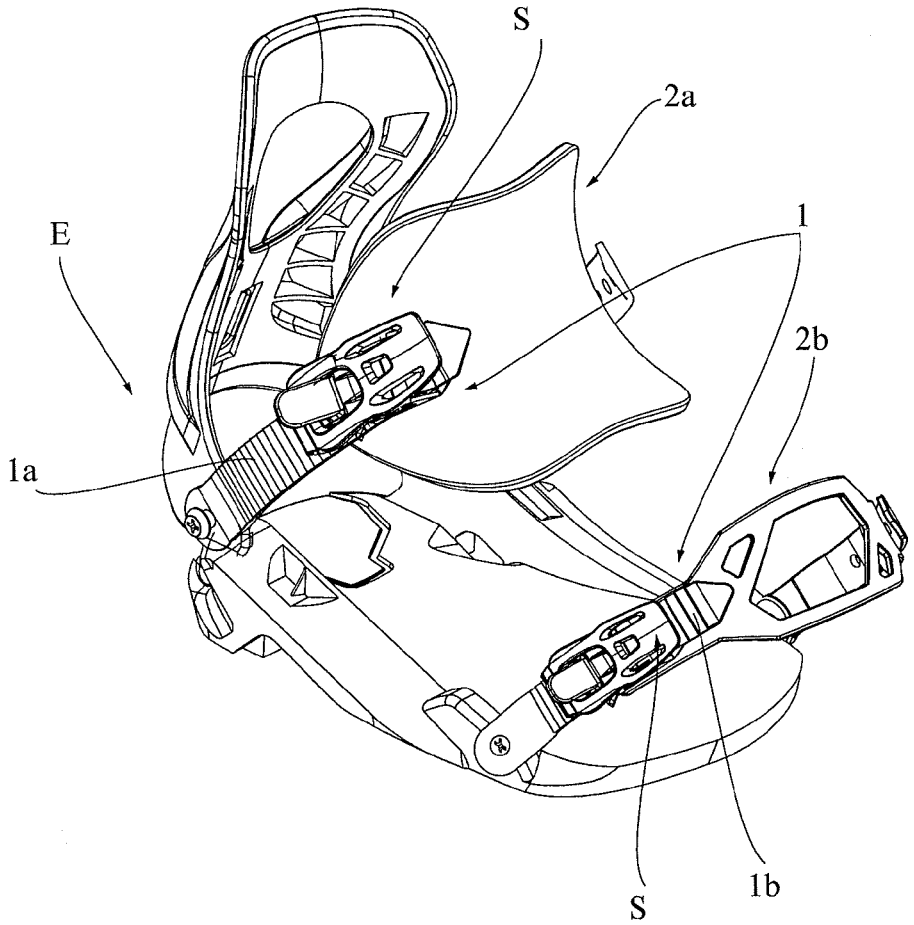
FIG. 1 shows a partial perspective view of a traditional retaining device according to the prior art.

FIG. 1 shows a traditional retaining device designed to fasten a shoe on a gliding board, and more particularly in this case, a snowboard, in the locked position.

This device traditionally comprises a lower base or rigid shell E designed to be secured or anchored on a board (not shown) and designed to receive a shoe or boot (also not shown).

The base E is provided with at least one upper fastener 1, and here, two fasteners 1*a*, 1*b* closing the device while being secured to the base E on the one hand, and blocked or locked on a central tab 2 on the other hand (and here, a rear tab 2*a* and a front tab 2*b*, respectively) bearing on the shoe, after tightening of the tabs 2*a*, 2*b* on the shoe.

The device is further equipped with at least one blocking member S for the fastener 1 (here 1*a*, 1*b*, respectively) generally secured to the central tab 2 (2*a*, 2*b*, respectively).

The length of the fasteners 1*a*, 1*b* can be adjusted using the blocking member S, which in some cases also ensures tightening of the tabs 2*a*, 2*b* on the shoe.

When there are two tabs 2, as in the illustrated embodiment, as long as the fastener 1*a* blocked on the tab 2*a* keeps the leg and foot in the base, the rear tab 2*a* forms a wedging and damping cushion that hugs the upper part of the shoe, and in particular, the instep.

The fastener 1*b* and the front tab 2*b* keep the front end of the shoe in the base E.

The invention aims to improve this traditional device by modifying the structure of the central tab 2.

In the embodiment of the invention illustrated by FIGS. 2*a*, 2*b* and 3*a* to 3*c*, the central tab 2 comprises an assembly made up of two parts, respectively, a flexible inner comfort part 21 and a rigid outer reinforcing part 22.

The two parts have substantially the same dimensions and the same bent, curved profile, since they are designed to be assembled with one another to form a single compact element 2 nevertheless having different and complementary mechanical properties on its inner and outer faces.

Figure 2A:
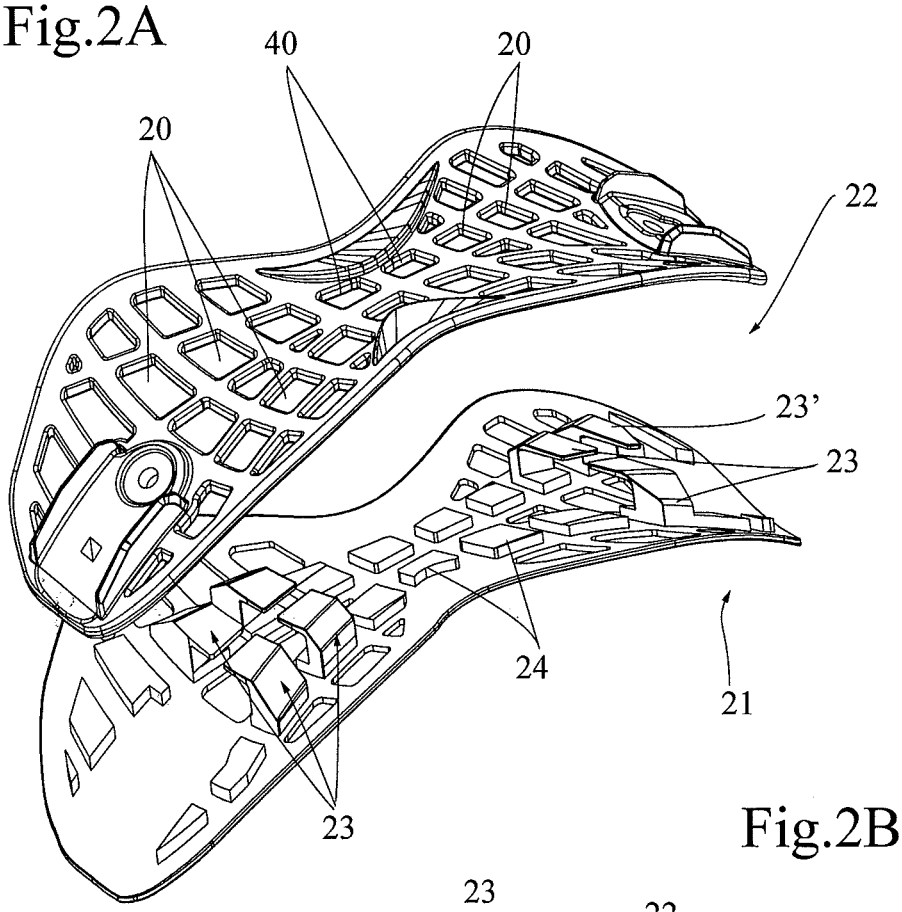
FIGS. 2A and 2B show partial exploded perspective views of one embodiment of the device according to the invention, respectively, before and after assembly of the two component parts of the central connecting tab.
Figure 2B:
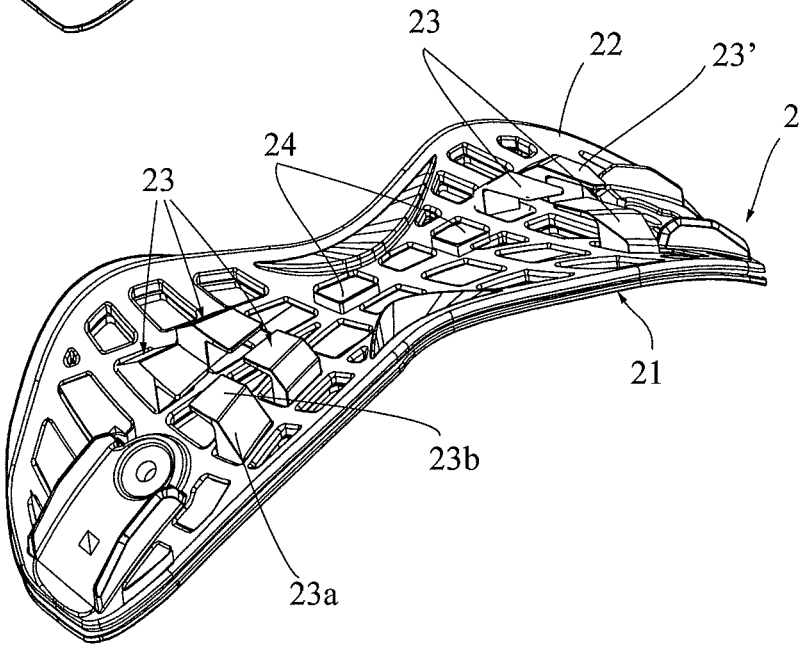
Figure 3A:
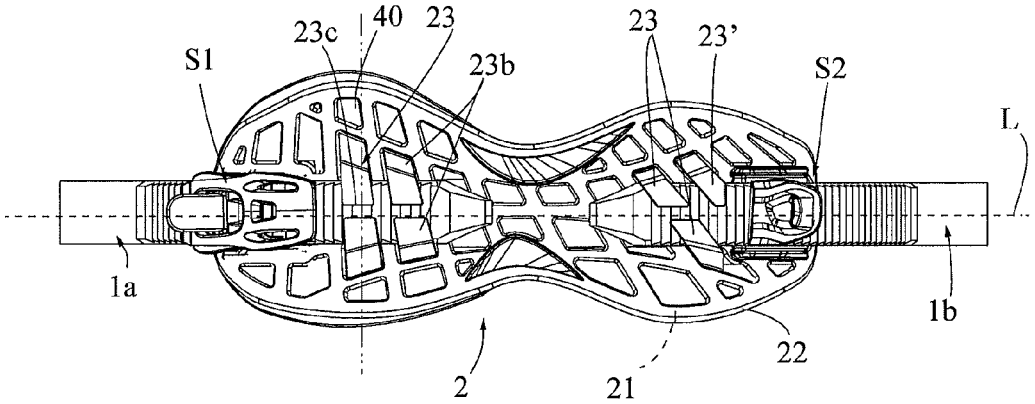
FIGS. 3A, 3B and 3C show partial top, perspective and side views, respectively, of the embodiment of the device according to the invention already illustrated by FIGS. 2A and 2B with the fastener in the locking position.
Figure 3B:
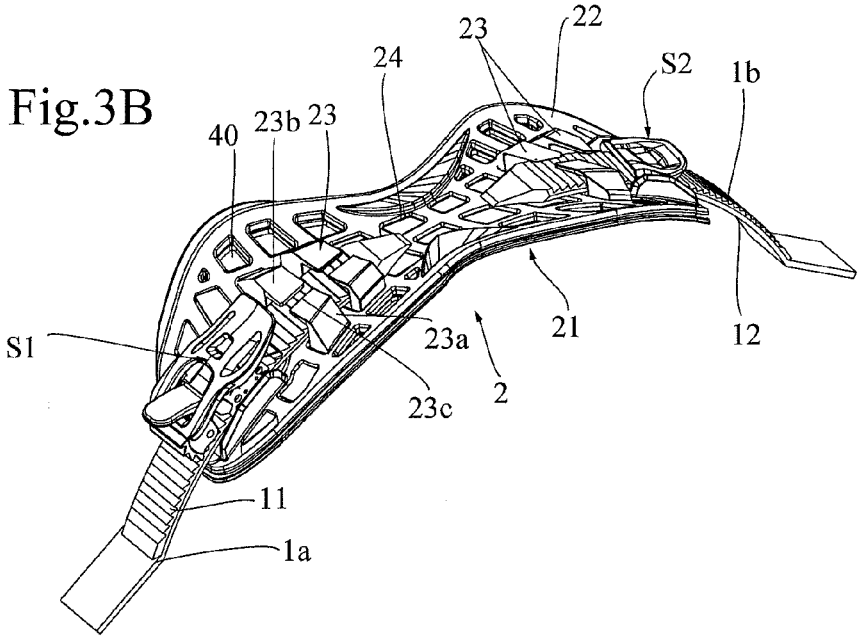

More specifically and as illustrated by FIGS. 2A and 2B, the inner part 21 and the outer part 22 are superimposed on one another. They extend below tightening fasteners 1*a*, 1*b* in the closed position of the device, as illustrated by FIGS. 3A and 3B.

However, the shapes of the two parts could be different, and preferably, the inner part 21 could be wider than the outer part 22 to isolate the shoe from the rigid part 22 and avoid compression spots on the user's foot. The parts may also be planar or non-bent, their respective flexibilities making it possible then to hug the curved shape of the upper part of the shoe by deformation.

It is certainly provided that the two parts can be made with different plastic materials, but it would be possible to make them from the same material by adjusting the hardness and/or thickness of each part.

Indeed, the interface of the tab 2 is designed to come into bearing contact with the shoe by hugging the top part of the upper as closely as possible at the instep.

Consequently, the inner part 21 must have an elastic deformation capacity to provide comfort to the user.

In particular, the inner part 21 can be a part injected with a plastic material such as polyurethane, polyamide or EVA (ethylene vinyl acetate) with a low hardness of approximately 60 Shore A and a mean thickness between 3 and 8 mm.

Furthermore, the outer face 22 of the tab 2 here bears two blocking members S1, S2 (FIGS. 3A, 3B and 3C but not shown in FIGS. 2A and 2B) and is thus subject to the traction stresses exerted by the fastener 1 here comprising the notched lateral fasteners formed here by racks 11, 12, which are mounted on both sides (left and right) of the tab 2 (the right side of the tab 2 being placed on the side of the inner flank of the shoe).

Figure 3C:
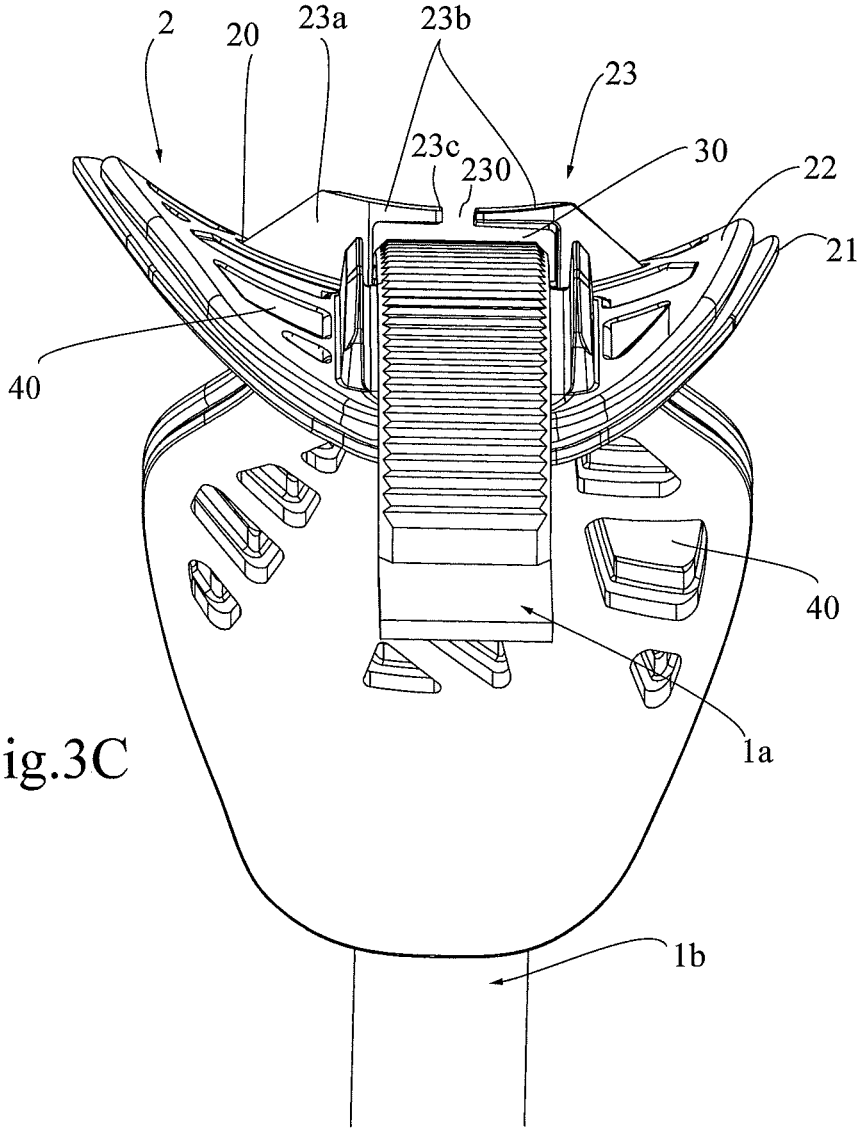

The device according to the invention has been shown in FIGS. 3A to 3C with rack-type fasteners, but these fasteners can be of another type such as, for example, a fastener provided with holes as illustrated by FIG. 1 (inner right side of the shoe) or a fastener provided with various toothed or notched profiles.

The part 22 can be positioned on the upper portion of the shoe, preferably, in a laterally centered position relative thereto owing to the choice of adjustments of the length of each of the two fasteners 11 and 12 and the blockages of those two fasteners 11 and 12 in the chosen positions owing to the two blocking members S1, S2. In illustrated case, the tab 2 is next tightened by the blocking member S1, which has kinematics making it possible to perform that tightening.

Consequently, the outer part 22 must have good deformation resistance so as not to stretch during tightening of the fasteners and to avoid any play or harmful movement of the shoe in the base.

Consequently, the outer part 22 constitutes a reinforcing part made from a material more rigid than the inner part 21. In particular, it can be made from an injected plastic material of the polyurethane or polyamide type for example, with a hardness greater than the hardness of the material used for the inner part, of approximately 60 Shore D. Its thickness is preferably between 2 and 6 mm.

This outer part 22 is preferably open-worked to reduce its weight while keeping material lines oriented in the longitudinal and transverse direction in order to obtain enough rigidity. This rigid part nevertheless remains flexible enough to be able to adapt to the shape of the upper part of the shoe.

In parallel, oftentimes the fastener 1, once adjusted to the proper length and blocked in the longitudinal position by the member S to immobilize the shoe in the base E, has an end segment which, after having usefully been used for manual grasping, is free and not under tension on the upper face of the tab 2, since it is situated past the blocking and/or tightening member.

Yet the presence of this free segment can cause bother or even safety risks for the surfer, since it protrudes, from the central tab 2, over a length that may sometimes be long and can catch accidentally on outer elements.

The invention has therefore made it possible both to optimize the respective functions of the two component parts of the central tab and to capture at least one part of the excess length of the fastener after blocking and/or tightening thereof.

To that end, the flexible inner part 21 bears at least one protruding element such as a lug 23 that engages in a corresponding orifice 20 arranged through the outer part 22 while forming a loop for the fastener 1 while ensuring locking of the two parts 21, 22.

The lug 23 here is made in a single piece with the inner part 21 and, once the inner and outer parts are assembled, the lug 23 extends past the upper face of the outer part 22 as illustrated by FIG. 2B.

The lug 23 can be made to be elastically deformable to facilitate its insertion and passage in the through orifice 20.

However, when the lug 23 is more rigid, its insertion in the orifice 20 can be obtained by deformation of the inner part 21.

In another alternative, the lug 23 will be forcibly inserted into the orifice 20.

With this arrangement, the assembly of the two parts has some play unless the locking has been completed either by injecting an adhesive in their small intercalary space or, according to one alternative that is not shown, by the joint presence of spurs and cavities made on their opposite face.

In the embodiment illustrated in particular by FIG. 3C, the lug 23 comprises two substantially perpendicular branches 23*a*, 23*b*.

More specifically, the first branch 23*a* connects the lug 23 to the part 21 and extends substantially perpendicular to the upper face of said part.

This intermediate branch here has a truncated shape with a widened base whereof the dimensions and the section are very close (or identical) to those of the orifice 20 arranged opposite on the part 22 that is designed to receive it.

Once inserted in the orifice 20, the branch 23*a* protrudes above the upper face of the part 22, with slight play if applicable.

The branch 23*a* is extended by an end branch 23*b* that extends at 90° relative to the branch 23*a* and substantially parallel to the upper face of the outer part 22.

When the two parts are assembled, the free intercalary space 30 delivered between the branch 23*b* and the upper outer face of the part 22 allows the passage of an end segment of this fastener 1 like a belt loop or bracelet loop.

The inner part 21 bears at least one series of protruding elements or lugs 23 grouped together, for most of them, in pairs and whereof the respective free ends of the branches 23*b* come across from one another in order to improve the upward retention of the fastener 1.

In the embodiment illustrated by FIGS. 3A to 3C, the inner part 21 bears two series of lugs, each cooperating with a lateral fastener 11, 12 blocked on either side of the central tab 2.

The number of lugs can be increased in order to still further improve the guiding and effectiveness of the retention of the fastener on the tab 2.

Only the final and seventh element 23' positioned on the right side of the tab 2 is isolated here (FIG. 3A), not having another lug across from it.

The cooperation of a plurality of protruding elements 23 with orifices 20 dedicated to them thus makes it possible to improve the holding of the assembly between the two parts 21, 22 as well as the immobilization of the free part of the fastener 1 (and in the alternative of FIGS. 3A to 3C, of each of the two fasteners 11, 12).

The facing ends of the branches 23*b* of the lugs 23 define a slit 23, the width of which is smaller than that of the fastener 1 and, if applicable, smaller than 1 mm, or even with joined ends.

According to one alternative that is not shown, the protruding elements are made in the form of single-piece bridges each engaged in a same orifice, the two branches 23*b* forming a single upper branch retaining the end segment of the fastener, the single end branch 23*b* being connected by its ends to two intermediate branches 23*a*, respectively.

Preferably, the edges 23*c* of the end branch 23*b* of the lugs 23 are straight and oriented parallel to the longitudinal axis L (FIG. 3A) passing through the two blocking members S1, S2 on the outer part 22 and corresponding, at least, to that of the idle fastener.

However, some edges can be oriented differently, as is in particular the case for the edge of the lug 23' situated on the right side of the tab 2 (FIG. 3A), which is beveled to facilitate guiding of the fastener toward the intercalary loop-forming space 30.

The branches 23*b* of the lugs 23 can be oriented from 0° to 90° relative to the axis L and on the right side of FIG. 3A, preferably at 45°.

The inner part 21 further bears bosses or studs 24 designed to be positioned or clipped in complementary cavities or recesses 40 arranged across therefrom on the outer part 22 to reinforce the interlocking and mutual wedging of the two parts after assembly, as illustrated by FIGS. 2A and 2B.

Some cavities can, however, remain free in order to arrange, on the inner part 21 and/or on the part 22, zones with the greater flexibility and also decrease the weight of the tab 2.

The invention claimed is:

1. A device for retaining a shoe on a gliding board comprising a lower base designed to be secured to the board and receiving the shoe, and at least one upper fastener ensuring closing of the device while being secured to the base on the one hand, and locked on a central tab bearing on said shoe on the other hand, in the locked position, wherein said central tab comprises an inner part and an outer part that are superimposed, said inner part including at least one protruding element becoming engaged through a corresponding orifice arranged in the outer part, the protruding element forming a loop for said fastener, and wherein said protruding element is a lug comprising two substantially perpendicular branches, the end branch extending remotely and substantially parallel to said outer part to delimit said loop designed for the housing of the fastener.

2. The device according to claim 1, wherein the protruding element is elastically deformable.

3. The device according to claim 1, wherein said end branch connects to the inner part via an intermediate branch crossing through the facing orifice arranged on the outer part.

4. The device according to claim 1, wherein the inner part bears at least one series of protruding elements grouped together in pairs and the free ends of which are across from one another two by two.

5. The device according to claim 4, wherein said inner part bears two series of protruding elements, each cooperating with a lateral fastener locked on either side of said central tab.

6. The device according to claim 4, wherein the opposite free ends of these protruding elements delimit a slot whose width is smaller than the width of the fastener.

7. The device according to claim 1, wherein said protruding element is in the form of a bridge whereof the end branch is connected by its ends, respectively, to two intermediate branches.

8. The device according to claim 1, wherein the outer part forms a reinforcement and has a rigidity greater than the inner comfort part.

9. The device according to claim 1, wherein said inner part further bears bosses designed to clip under stresses in complimentary cavities arranged opposite on each outer part to reinforce the mutual wedging of the two parts after assembly.

10. The device according to claim 1, wherein said protruding element borne by the inner part is forcibly engaged in the matching orifice situated on the outer part to ensure the assembly of said inner and outer parts.

11. The device according to claim 1, wherein said inner part has the same profile and the same dimensions as the outer part.

12. A device for retaining a shoe on a gliding board comprising a lower base designed to be secured to the board and receiving the shoe, and at least one upper fastener ensuring closing of the device while being secured to the base on the one hand, and locked on a central tab bearing on said shoe on the other hand, in the locked position, wherein said central tab comprises an inner part and an outer part that are superimposed, said inner part including at least one protruding element becoming engaged through a corresponding orifice arranged in the outer part, this protruding element forming a loop for said fastener and wherein the outer part forms a reinforcement and has a rigidity greater than the inner comfort part.

* * * * *